US005214878A

United States Patent [19]

Watt

[11] Patent Number: 5,214,878

[45] Date of Patent: Jun. 1, 1993

[54] SECURITY DOOR ASSEMBLY

[75] Inventor: Ronald W. Watt, Glasgow, Scotland

[73] Assignee: SPS (Holdings) Ltd., Glasgow, Scotland

[21] Appl. No.: 823,655

[22] Filed: Jan. 23, 1992

[30] Foreign Application Priority Data

Jan. 24, 1991 [GB] United Kingdom ..... 9101535

[51] Int. Cl.[5] ..... E05D 7/00; E06B 3/00

[52] U.S. Cl. ..... 49/398; 49/394; 49/501

[58] Field of Search ..... 49/501, 503, 394, 398, 49/399, 381

[56] References Cited

U.S. PATENT DOCUMENTS 4,979,264 12/1990 Ramsauer ..... 49/398 X

FOREIGN PATENT DOCUMENTS 0256788A 2/1988 European Pat. Off. .
2051191A 1/1981 United Kingdom .
2194275A 3/1988 United Kingdom .
2194276A 3/1988 United Kingdom .
2205886A 12/1988 United Kingdom .
2212542A 7/1989 United Kingdom .
2226355A 6/1990 United Kingdom .
2233695A 1/1991 United Kingdom .

*Primary Examiner*—Philip C. Kannan
*Attorney, Agent, or Firm*—Keck, Mahin & Cate

[57] ABSTRACT

A security door assembly comprising a panel having inner and outer faces, a shallow peripherally extending sidewall having an inwardly turned rim, extending substantially parallel to the inner and outer faces of the panel, mounting means, comprising at least two first mounting members, and at least two second mounting members, the first and second mounting members being interconnected e.g. by bolts so that an entrance surround of a building can be clamped between the first and second mounting members, the second mounting members having, adjacent one end, a support bracket of generally U-shaped configuration, with the web of the U being positioned to extend parallel to the inner face of the door when the door is in the closed position and the arms of U extending vertically, the first arm of the U being secured adjacent one end of said second mounting member, and the second arm being disposed outwardly of the first arm, a hinge having first and second hinge plates, the first hinge plate being secured to the second arm of the U and the second hinge plate being secured to a vertical portion of an inwardly turned rim of the panel and a lock and catch arrangement cooperatingly mounted on the second mounting member and the inner face of the panel at a location spaced from said one end thereof.

10 Claims, 4 Drawing Sheets

SECURITY DOOR ASSEMBLY

The present invention relates to a security door assembly for use in particular in doors and windows of temporarily unoccupied premises.

The problem often arises with temporarily unoccupied premises of vandalism and various attempts have been made to reduce this problem by boarding up doors and windows either with wood or with reinforced panels of one sort or another. Of course such boarding often involves securing from the outside and can be readily dismountable to give access by a vandal to the interior.

GB-A-2194275 and 2212542 each show security door assemblies which show an improvement on such an arrangement. However, they are relatively complex and not entirely satisfactory in preventing access from the exterior.

It is now proposed, according to the present invention, to provide a security door assembly comprising a panel having inner and outer faces, a shallow peripherally extending sidewall having an inwardly turned rim, extending substantially parallel to the inner and outer faces of the panel, mounting means for mounting the assembly on the entrance surround of a building, a support bracket of generally U-shaped configuration, with the web of the U being positioned to extend parallel to the inner face when the door is in the closed position and the arms of the U extending vertically, the first arm of the U being secured to said mounting means and the second arm being disposed outwardly of the first arm, a hinge having first and second hinge plates, the first hinge plate being secured to the second arm of the U and the second hinge plate being secured to a vertical portion of the inwardly turned rim of the panel and a lock and catch plate cooperatingly mounted on the mounting means and the inner face of the panel at corresponding locations.

Such a structure can be made relatively inexpensively and because the effect of the structure of mounting of a hinge is such as essentially completely to enclose the hinge, it is extremely difficult for a vandal to attain access by inserting a jemmy or crowbar between the door and the door opening.

In a preferred structure, a vertical portion of the inwardly turned rim has, extending from the free ends thereof, a flange extending generally parallel to the adjacent portion of the peripherally extending sidewall, and an L-shaped bracket is provided which has one leg secured to said flange and the other leg is secured to the second hinge plate. This facilitates the mounting of the second hinge plate and the whole hinge assembly is, as indicated above, mounted effectively in the space enclosed by the peripheral wall, its rim and a flange attached to the rim giving still further security.

The second arm of the supporting bracket is advantageously significantly shorter, e.g. half the length of the first arm thereof, whereby the first arm is adequate to provide a secure mounting point and the second arm can provide adequate space for the holding of the hinge.

The mounting means may comprise at least two first mounting members and at least two second mounting members, the second of the mounting members being so interconnected to the first mounting members that an entrance surround of a building can be clamped between the first and second mounting members.

It is most convenient for a lock to be mounted on the second mounting member and for the catch plate associated with the lock to be mounted on the inner surface of the door and advantageously the lock is mounted adjacent the other end of the second mounting member. In fact a lock can be associated with each mounting member for greater security.

Alternatively, the mounting means comprises mounting plates rigidly secured to said support bracket and apertures formed in said mounting plates for passage of screws screwable into a door jamb.

In a further construction the mounting means comprises mounting bars. The mounting bars may be telescopic so that they may be adjusted to different door widths, said catch plates are mounted on one free end of each said mounting bar and said locks are mounted on said door.

In order that the present invention may more readily be understood, the following description is given, merely by way of example, reference being made to the accompanying drawings in which.

Figure 1:
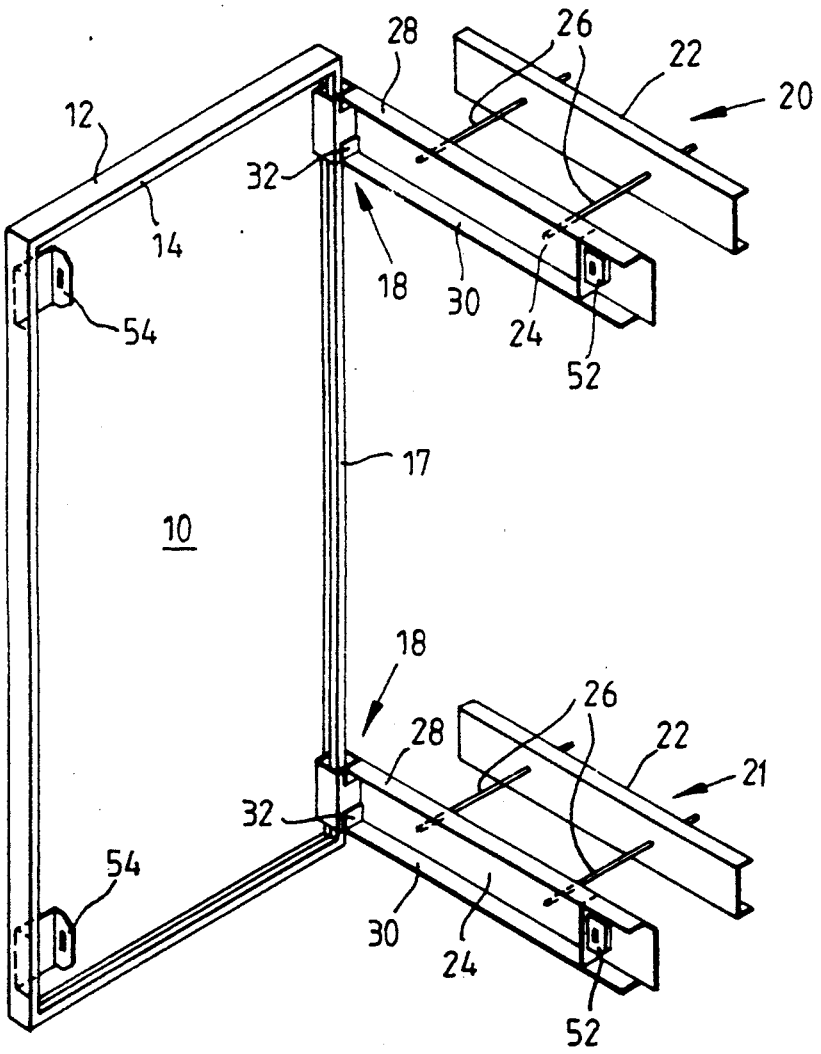
FIG. 1 is a schematic perspective view of one embodiment of security assembly according to the invention shown in the open position.

Turning first to FIG. 1, the door assembly includes a door panel 10 including a peripherally extending sidewall 12 having an inturned rim 14 which extends back inwardly substantially parallel to the inner and outer faces of the panel 10. As can be seen from FIGS. 2 and 3, the inturned rim 14 is provided, extending from the free edge thereof, with a flange 16 which extends generally parallel to the adjacent portion of the peripheral extending sidewall 12.

Associated with one vertical portion 17 of the peripheral wall 12 and its associated rim and flange, are upper and lower hinge assemblies 18.

In order to be able to mount the door assembly in a doorway, upper and lower mounting means 20, 21 are provided which are essentially identical to one another. They each comprise first and second mounting members 22, 24, respectively, these being interconnected by screw threaded members 26 and associated nuts (not shown). These interconnecting screws 26 and associated nuts are designed to enable the first and second mounting members 22, 24 to clamp a doorpost (not shown) therebetween.

It will be seen that each of the second mounting members 24 is of generally channel-shaped section having upper and lower flanges 28, 30, the left-hand ends of which, as seen in FIG. 1, have downturned and upturned end portions 32 respectively.

Figure 2:
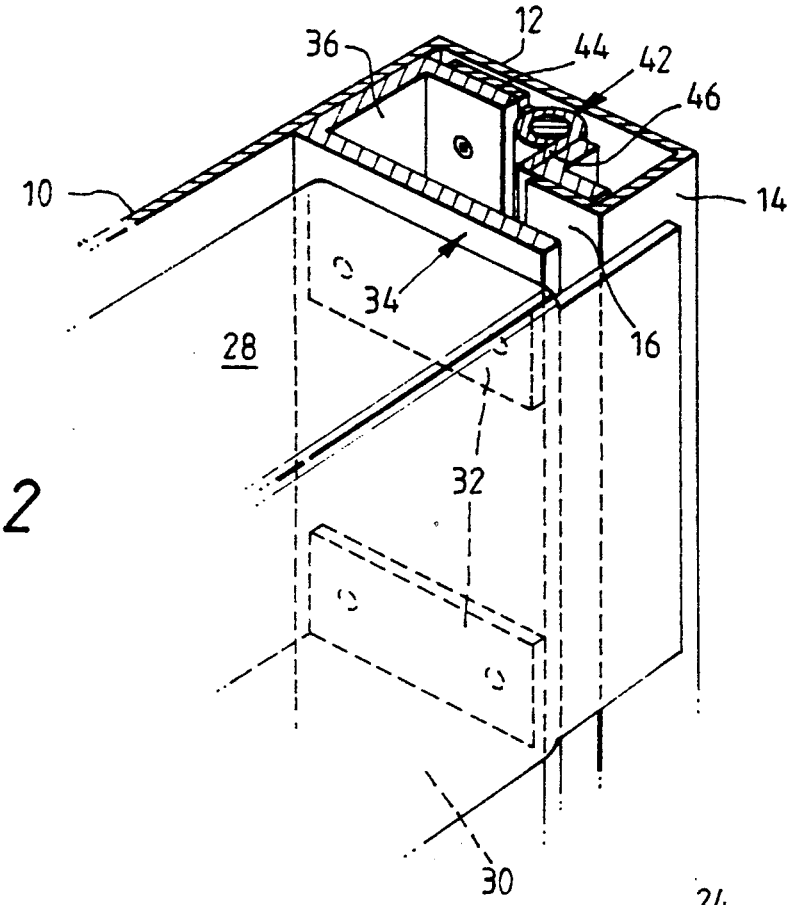
FIG. 2 is a fragmentary perspective view, to an enlarged scale, showing the mounting of the hinge assembly of the door of FIG. 1.
Figure 3:
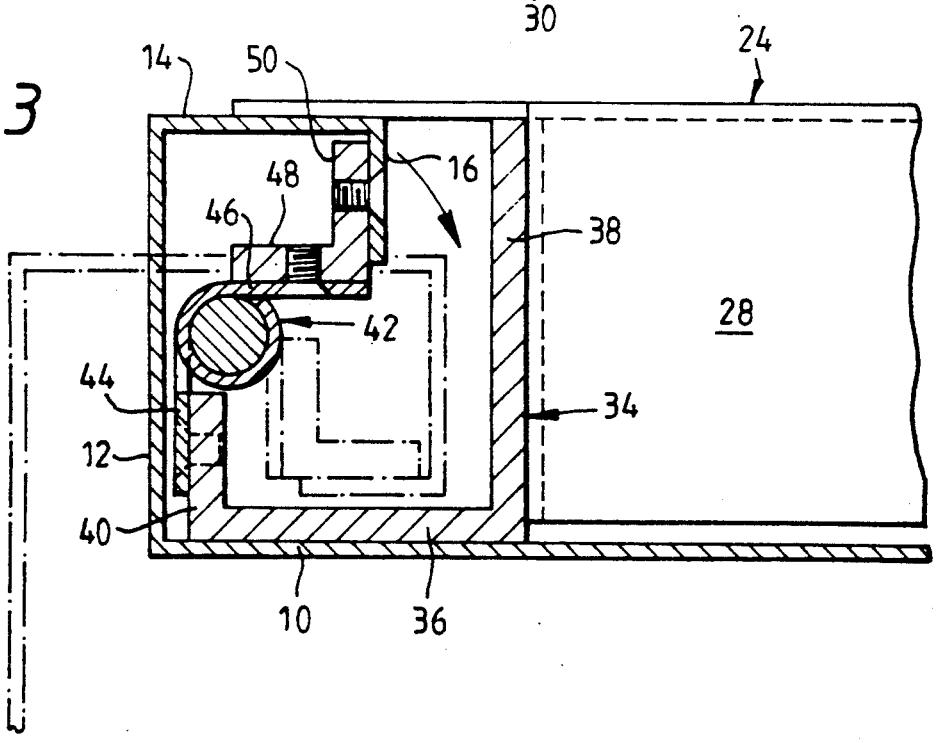
FIG. 3 is a still further enlarged cross-section through a portion of the hinge assembly of FIG. 2.

A generally U-shaped bracket 34, as seen in FIGS. 2 and 3, is provided with a web 36 which is positioned to extend parallel to the inner face of the door panel 10 when in its closed position, as seen in FIG. 3.

The U-shaped bracket further includes first arm 38 and a second, shorter arm 40.

A hinge 42 is shown as including first and second hinge plates 44, 46, the first hinge plate 44 being secured to the shorter arm 40 of the bracket 34 while the second plate 46 is secured to a first arm 48 of an L-shaped bracket the second arm 50 of which is secured to the inturned flange 16 associated with the vertical portion 17 of the peripheral rim 12.

Also associated with each of the second mounting members 30 is a lock 52 which is so positioned as to cooperate with a complementary catch plate 54 welded to the inner face of the panel 10.

It will be appreciated that the structure of the present invention is relatively simple and very secure. FIG. 3 illustrates, in phantom-line position, how the hinge operates and the door is illustrated, in fragment, in the open position. The movement of the various parts during hinging is illustrated in chain-dotted arcuate lines. It will be seen that the hinge 42 is almost entirely surrounded by the metal work of the door and of the second mounting member 28 so that it is difficult to cause any damage and thus obtain access through the door assembly of the invention.

Figure 4:
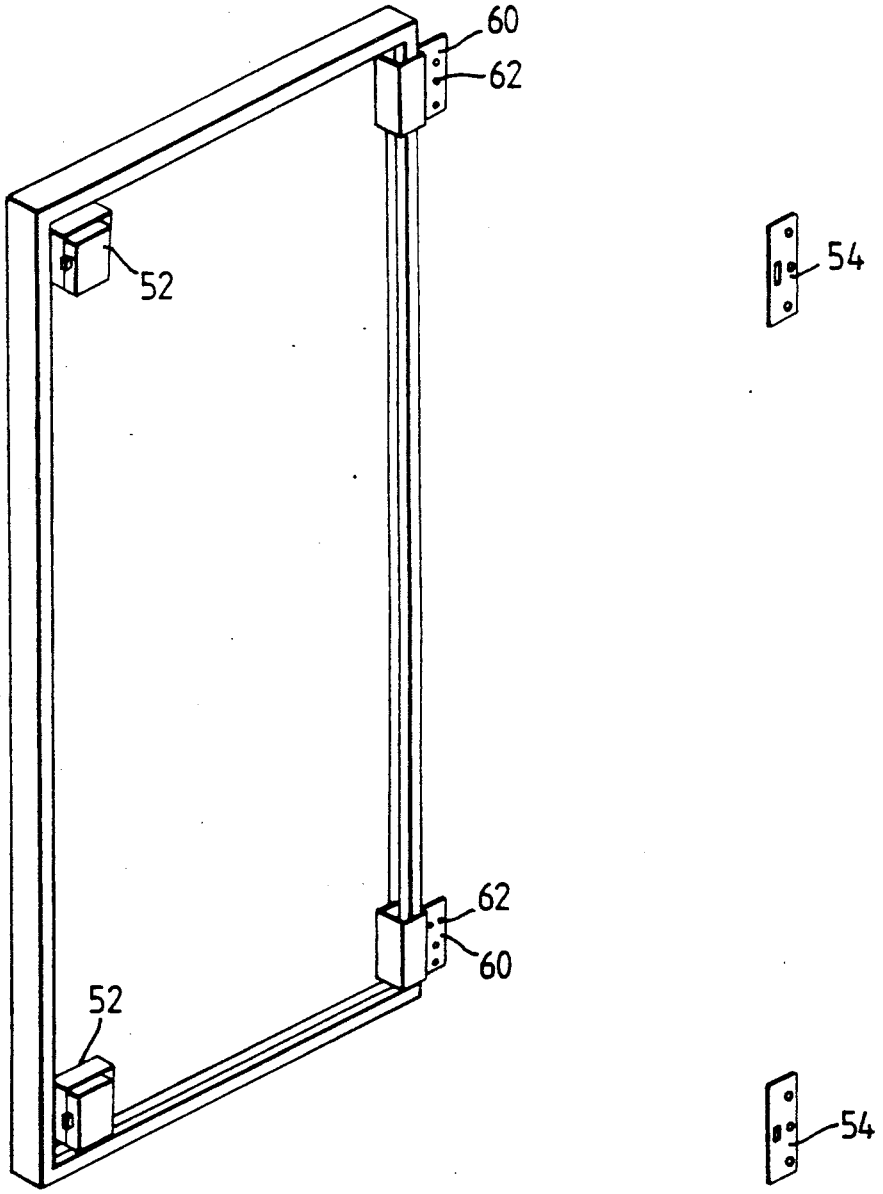
FIGS. 4 and 5 are each schematic perspective views, similar to FIG. 1, of two further embodiments of door assembly according to the invention.

If reference is now made to FIG. 4, a similar structure is shown in which the hinge arrangement is identical but the mounting means is modified. Instead of having the mounting members 20, 21 formed by first and second mounting members 22, 24, a single mounting plate 60 is secured to each of the support brackets 34, e.g. by being secured to the flange 16 shown in FIG. 4. The mounting plates 60 are formed with apertures 62 for the passage of screws which are screwable into the door jamb. The catch plates 54 are of similar structure to the mounting plates 60 and are likewise securable to the opposite door jamb to cooperate with the locks 52 which are mounted on the top and bottom outer corners of the inside of the door panel.

Figure 5:
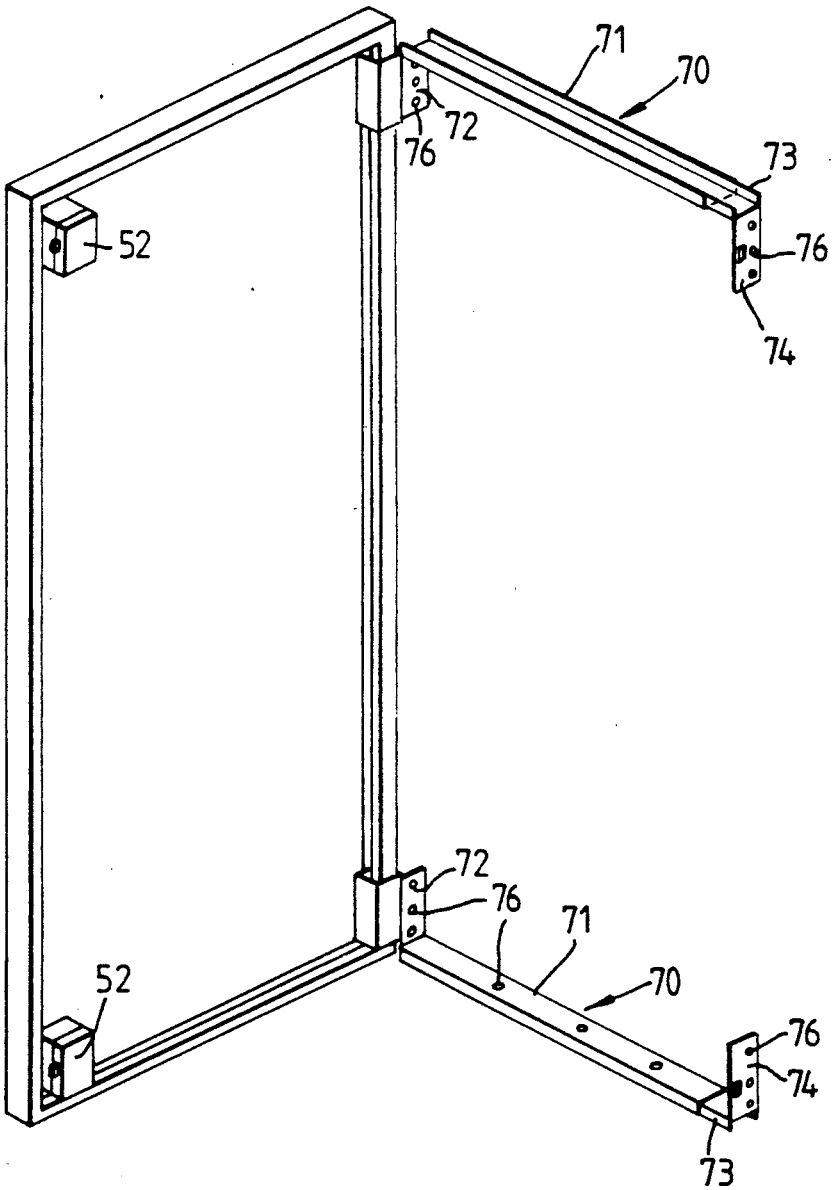

The structure of FIG. 5 is generally very similar but there are provided upper and lower mounting bars indicated by the general reference numeral 70, this being telescopic having a first portion 71 secured to a mounting plate 72 provided with apertures 76 for securing to the door jamb. The second telescopic bar 73 of the mounting bars 70 has attached to its free end a catch plate 74 again provided with apertures 76 for screw holes. Further screw holes are provided in the mounting bars 70 for securing these mounting bars to the lintel and threshold of the door frame. It will be appreciate that in this way the telescopic bar 70 can be adjusted to the desired length for a particular door frame width and the mounting bars can be very securely fixed by screws passing through the telescopic bar parts 71 as well as the mounting plate 72 and catch plate 76.

Again, locks 52 are provided to cooperate with the latch plates 74.

What is claimed is:

1. A security door assembly comprising a panel having inner and outer faces, a shallow peripherally extending sidewall, an inwardly turned rim to said sidewall, extending substantially parallel to the inner and outer faces of the panel, mounting means for mounting the assembly on the entrance surround of a building, a support bracket of generally U-shaped configuration, comprising a web and first and second arms, with the web of the U being positioned to extend parallel to the inner face when the door is in the closed position and the arms of the U extending vertically, the first arm of the U being secured to said mounting means and the second arm being disposed outwardly of the first arm, a hinge having first and second hinge plates, the first hinge plate being secured to the second arm of the U and the second hinge plate being secured to a vertical portion of the inwardly turned rim of the panel and a lock and catch plate cooperatingly mounted on the mounting means and the inner face of the panel at corresponding locations.

2. A security door assembly as claimed in claim 1, wherein said mounting means comprise at least two first mounting members and at least two second mounting members, and means interconnecting the second of the mounting members to the first mounting members whereby an entrance surround of a building can be clamped between the first and second mounting members.

3. A security door assembly as claimed in claim 2, wherein said lock is mounted on the second mounting member and said catch plate associated with the lock is mounted on the inner surface of the door.

4. A security door assembly as claimed in claim 3, wherein said second mounting member further comprises first and second ends, wherein said first arm of the U is secured to the said first end of the second mounting member and wherein the lock is mounted adjacent to the second end of said second mounting member.

5. A security door assembly as claimed in claim 4, wherein a lock is associated with each mounting member for greater security.

6. A security door assembly as claimed in claim 1, and further comprising, extending from the free ends of a vertical portion of the inwardly turned rim, a flange extending generally parallel to the adjacent portion of the peripherally extending sidewall, and an L-shaped bracket having two legs, one leg being secured to said flange and the other leg being secured to the second hinge plate.

7. A security door assembly as claimed in claim 1, wherein the second arm of the supporting bracket is significantly shorter, e.g. half the length, of the first arm thereof, whereby the first arm is adequate to provide a secure mounting point and the second arm can provide adequate space for the holding of the hinge.

8. A security door assembly as claimed in claim 1, wherein said mounting means comprises mounting plates rigidly secured to said support bracket and apertures formed in said mounting plates for passage of screws screwable into a door jamb.

9. A security door assembly as claimed in claim 1, wherein said mounting means comprises mounting bars and apertures formed therein for the passage of screws screwable into a door frame lintel and threshold.

10. A security door assembly as claimed in claim 9, wherein said mounting bars are telescopic so that they may be adjusted to different door widths, said catch plates are mounted on one free end of each said mounting bar and said locks are mounted on said door.

* * * * *